US010261473B2

(12) United States Patent
Bell

(10) Patent No.: US 10,261,473 B2
(45) Date of Patent: Apr. 16, 2019

(54) WRISTBAND FOR USE WITH WRIST-WORN DEVICE

(71) Applicant: Bridger Bell, Santa Monica, CA (US)

(72) Inventor: Bridger Bell, Santa Monica, CA (US)

( * ) Notice: Subject to any disclaimer, the term of this patent is extended or adjusted under 35 U.S.C. 154(b) by 20 days.

(21) Appl. No.: 15/076,851

(22) Filed: Mar. 22, 2016

(65) Prior Publication Data

US 2016/0291547 A1 Oct. 6, 2016

Related U.S. Application Data

(60) Provisional application No. 62/142,454, filed on Apr. 2, 2015.

(51) Int. Cl.

| | |
|---|---|
| ***G04B 37/00*** | (2006.01) |
| ***A44C 5/14*** | (2006.01) |
| ***G04B 37/14*** | (2006.01) |
| *A41D 19/00* | (2006.01) |

(52) U.S. Cl.

CPC ..... *G04B 37/0033* (2013.01); *A44C 5/14* (2013.01); *G04B 37/1486* (2013.01); *A41D 19/0027* (2013.01); *A41D 19/0037* (2013.01)

(58) Field of Classification Search

CPC .. G04B 37/0033; G04B 37/1486; A44C 5/14; A41D 19/0027; A41D 19/0037

USPC ..... 224/627

See application file for complete search history.

(56) References Cited

U.S. PATENT DOCUMENTS

| | | | | |
|---|---|---|---|---|
| 2,338,332 A | | 1/1944 | Jaten | |
| 2,431,392 A | | 11/1947 | Forstner | |
| D148,671 S | | 2/1948 | Babin | |
| 2,448,943 A | | 9/1948 | Wolff | |
| 2,511,333 A | | 6/1950 | Flatau | |
| 2,521,375 A | | 9/1950 | Johnston | |
| 2,558,007 A | | 6/1951 | Smith | |
| 2,573,055 A | | 10/1951 | Pedersen | |
| 2,747,779 A | | 5/1956 | Speck et al. | |
| 2,876,521 A | | 3/1959 | Legman | |
| 2,926,825 A | * | 3/1960 | Wing | A44C 5/00 224/164 |
| 2,937,798 A | | 5/1960 | Mort | |
| 3,254,396 A | | 6/1966 | Mushey | |
| 3,265,247 A | | 8/1966 | McKinney | |
| 3,362,595 A | | 1/1968 | Hilmar | |
| 3,469,749 A | | 9/1969 | Tabata | |
| 3,672,157 A | | 6/1972 | Manceri | |
| 3,737,082 A | | 6/1973 | Millman | |
| 3,797,716 A | | 3/1974 | Mochizuki | |
| 4,417,437 A | | 11/1983 | Museki | |
| 4,681,462 A | * | 7/1987 | Lloyd | G04B 37/1486 224/164 |
| 5,848,030 A | | 12/1998 | Sullivan | |

(Continued)

FOREIGN PATENT DOCUMENTS

| | | |
|---|---|---|
| CN | 201750752 | 2/2011 |
| CN | 202364967 | 8/2012 |

(Continued)

*Primary Examiner* — Peter N Helvey

(74) *Attorney, Agent, or Firm* — Trop, Pruner & Hu, P.C.

(57) ABSTRACT

In one embodiment, an apparatus includes a wristband adapted to position a watch face substantially over at least one of a lateral radial portion of a wrist of a user or an anatomical snuffbox of the user. In an example, this watch face may be part of a smartwatch or other personal electronic device.

14 Claims, 18 Drawing Sheets

(56) References Cited

U.S. PATENT DOCUMENTS

| | | | | |
|---|---|---|---|---|
| 6,899,255 | B2 | 5/2005 | Pringle | |
| 7,959,351 | B1 * | 6/2011 | Thorpe | A41D 19/0027 224/164 |
| 8,191,210 | B2 * | 6/2012 | Devers | A44C 5/0053 224/170 |
| D809,953 | S * | 2/2018 | Gilmore | D11/3 |
| D809,954 | S * | 2/2018 | Gilmore | D11/3 |
| 2003/0044180 | A1 | 3/2003 | Lindberg | |
| 2003/0099163 | A1 | 5/2003 | Yang et al. | |
| 2010/0316369 | A1 | 12/2010 | Pyle | |
| 2016/0157571 | A1 * | 6/2016 | Custer | A44C 5/08 224/175 |
| 2017/0035190 | A1 * | 2/2017 | Gilmore | A45F 5/00 |
| 2017/0075308 | A1 * | 3/2017 | Ivesha | G04G 17/04 |

FOREIGN PATENT DOCUMENTS

| | | |
|---|---|---|
| CN | 202407379 | 9/2012 |
| CN | 203058583 | 7/2013 |
| CN | 103561163 | 2/2014 |
| CN | 103750604 | 4/2014 |
| EP | 2631893 | 8/2013 |
| EP | 2782088 | 9/2014 |

* cited by examiner

WRISTBAND FOR USE WITH WRIST-WORN DEVICE

This application claims priority to U.S. Provisional Patent Application No. 62/142,454, filed on Apr. 2, 2015, in the name of Bridger Bell, entitled "Watch Band to Eliminate Wrist Pronation (or Supination) and Greatly Reduce Medial Shoulder Rotation Required for Viewing and Interacting with a Watch Face," the disclosure of which is hereby incorporated by reference.

BACKGROUND

Whereas traditional watch faces are only viewed for a few seconds to ascertain the time, smartwatches introduce the problem of arm discomfort from prolonged interactions with the watch face. Prior (or "traditional") wristbands place the watch face on the posterior (or sometimes anterior) surface of the wrist with the vertical axis of the watch face perpendicular to the length of the forearm; this requires pronation (or supination) of the wrist and requires substantial medial rotation of the shoulder in order to align the vertical axis of the watch face with a natural line of sight for viewing and interactions with the device. Further, the traditional placement of the watch face on the posterior surface of the wrist leaves the watch face out of a natural line of sight during many common activities such as writing, holding a steering wheel and using a mobile phone for activities such as texting, gaming, browsing and most uses other than holding it up to the ear.

SUMMARY OF THE INVENTION

The present embodiments of the invention aim to alleviate the problem of arm discomfort and potential repetitive stress injury resulting from extended pronation (or supination) of the wrist and substantial (e.g. more than ~45 degree) medial rotation of the shoulder required for prolonged interaction with a watch face and to present a more ergonomic alternative placement on the arm.

The present embodiments of the invention also aim to place the watch face in a natural line of sight during many common activities such as writing, holding a steering wheel and using a mobile phone for activities such as texting, gaming, browsing and most uses other than holding it up to the ear.

The present embodiments relate to wristbands, or watchbands, adapted to hold watches and watch faces, including: watches, smartwatches, electronic displays, cameras, wearable computer displays, or wearable user-input surfaces, any of which may be referenced below as a "watch face."

The embodiments provide a wristband conducive to prolonged (e.g. more than a few seconds) viewing of and interaction with the watch face to accommodate the greater degree, extent, and duration of viewing and interactions desired with smartwatches, electronic displays, wearable computer displays and/or cameras, or wearable user-input surfaces. Both traditional wristbands and the present embodiments require elbow flexion for user viewing and interaction with the watch face. Traditional wristbands additionally require wrist pronation (or supination) and substantial medial shoulder rotation (e.g. more than ~45 degrees). The present embodiments eliminates the need for wrist pronation or supination and reduces the degree of medial shoulder rotation required (e.g. to less than ~45 degrees) in order to achieve alignment of the vertical axis of the watch face with a natural line of sight.

These and other prior art position the watch face on either the posterior or anterior surface of the wrist, requiring pronation or supination of the wrist and substantial medial rotation of the shoulder (e.g. more than ~45 degrees) in order to view and interact with the watch face such that it falls in a natural line of sight from a neutral head position (or neutral with neck flexion) with the vertical axis of the watch face aligned with the vertical axis of the user's field of vision.

As such, no existing wristband is conducive to prolonged viewing of and interaction with the watch face, due to discomfort resulting from prolonged wrist pronation (or supination) and substantial medial shoulder rotation (e.g. more than ~45 degrees) required for viewing and interacting with watch face. Both pronation and supination of the wrist and medial shoulder rotation lead to discomfort and could potentially lead to repetitive stress injuries if prolonged and repeated over time.

Accordingly, present embodiments place the watch face in a position such that it can be viewed and interacted with without wrist pronation (or supination) and with reduced medial shoulder rotation (e.g. less than ~45 degrees). Further, the embodiments provide a wristband positioning the vertical axis of the watch face in alignment with the vertical axis of the user's field of vision from a neutral head position (or neutral with neck flexion) with reduced (e.g. less than ~45 degrees) medial shoulder rotation.

According to the preferred and full embodiment of the embodiments, a band for the securement around the wrist of the wearer that positions the watch face on the lateral radial portion of the wrist over the anatomical snuff box with the vertical axis of the watch face at least approximately parallel to a fully extended pointer finger.

The anatomical snuffbox is located on the lateral radial portion of the wrist, between the radius bone and the base of the thumb (in the vicinity of the trapezium).

According to one embodiment, the wristband places the watch face over the anatomical snuffbox. A portion of the watch face may lie abreast of the base of the thumb and thereby be stabilized on one side or one portion of the border of the watch face by the base of the thumb.

According to another embodiment, the wristband places the watch face higher on the forearm (up the forearm toward the elbow from the hand) over the lateral radial portion of the forearm.

According to one embodiment, the wristband includes or may be formed of solid, angled pieces or hinged assemblies adapting joints or slots to enable existing watch faces that were designed to join with traditional bands to now be adapted by the present embodiments to be worn on the lateral radial portion of the wrist over the anatomical snuff box.

According to another embodiment, the wristband securing the watch face may be built into the cuff of a glove or partial-glove that utilizes the structure of the hand for stable positioning.

According to one embodiment, the wristband includes strips or rods of rigid or semi-rigid material spanning the greater part of the anterior and/or posterior surface(s) of the wrist to secure the watch face on the lateral radial portion of the wrist.

According to another embodiment, the wristband could provide versatile multi-function to allow for traditional watch placement or placement over the anatomical snuffbox. Such an embodiment may have a circular casing that circumscribes the watch face, allowing a circular or polygonal watch face to turn radially inside the circumscribing circular casing to orient traditionally and alternately re-orient with the vertical axis aligned with a fully extended middle finger. Here, rigid or semi-rigid anterior- and/or posterior-wrist-surface removable inserts may provide stabilizing support for the watch face to be situated over the anatomical snuff-box when installed, and when removed, allow for traditional positioning on the posterior (or anterior) surface of the wrist.

According to any embodiment, part or all of the wristband may be comprised of elastic or inelastic, adjustable-length, or removable-link materials to accommodate variously sized and shaped wrists.

According to any embodiment, the watch face or display may contain or be comprised of a camera, or may act as a viewfinder for a camera positioned on the watch face on the lateral radial portion of the wrist, or as a viewfinder for a camera positioned opposite the watch face on the band, over the lateral ulnar surface of the wrist.

According to one embodiment, the backing of the watch face may be convex, may have a convex piece attached, or may rest on a convex portion of the watchband; this convex surface rests in the dimple of and is cradled by the concave contour of the anatomical snuff-box.

According to another embodiment, the backing of the watch face may be concave, may have a concave piece attached, or may rest on a rigid or semi-rigid concave portion of the watchband; this concave surface traces the contour of the lateral radial portion of the forearm, bridging from the posterior surface to the anterior surface over the radial portion.

Conventional wristbands have the horizontal axis of the watch face parallel to the length of the forearm and perpendicular to the length of the watchband, whereas the present embodiments has the horizontal axis of the watch face parallel to a fully extended thumb (when fully extended within the lateral plane of the radius and ulna), forming an approximately 30- to 60-degree reference angle (or 150- to 120-degree obtuse angle) with the length of the watchband.

Conventional watchbands attach the watch face at the top and bottom of the watch face along the vertical axis of the watch face. The present embodiments attaches the watchband to the watch face around and at opposite corners of the watch face along a diagonal or attaching to a watch face manufactured for a traditional watchband by way of an angled adaptor piece.

DETAILED DESCRIPTION

FIGS. 1-5,7-11 depict embodiments with the image of a traditional watch face, the image of which is a customizable viewing option on smartwatches. The 12-3-6-9 orientation of a traditional watch face image illustrates the orientation of the watch face's view screen in familiar terms, where the 12:00 and 6:00 positions are aligned substantially along a vertical axis of the watch face and the 9:00 and 3:00 positions are aligned substantially along a horizontal axis of the watch face.

Figure 5:
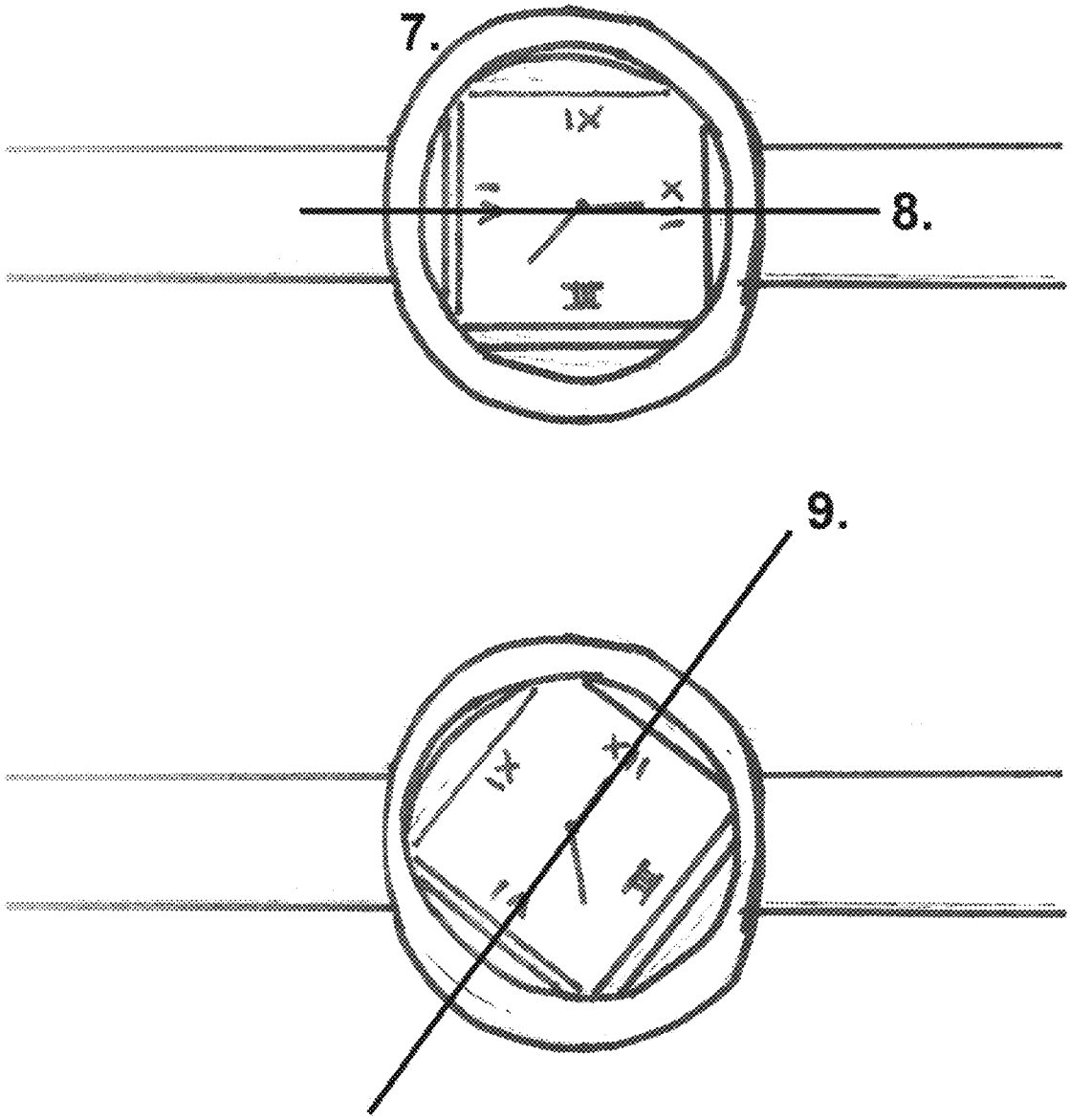
FIG. 5 shows a mechanism for rotating a watch face within a circular casing.
Figure 6:
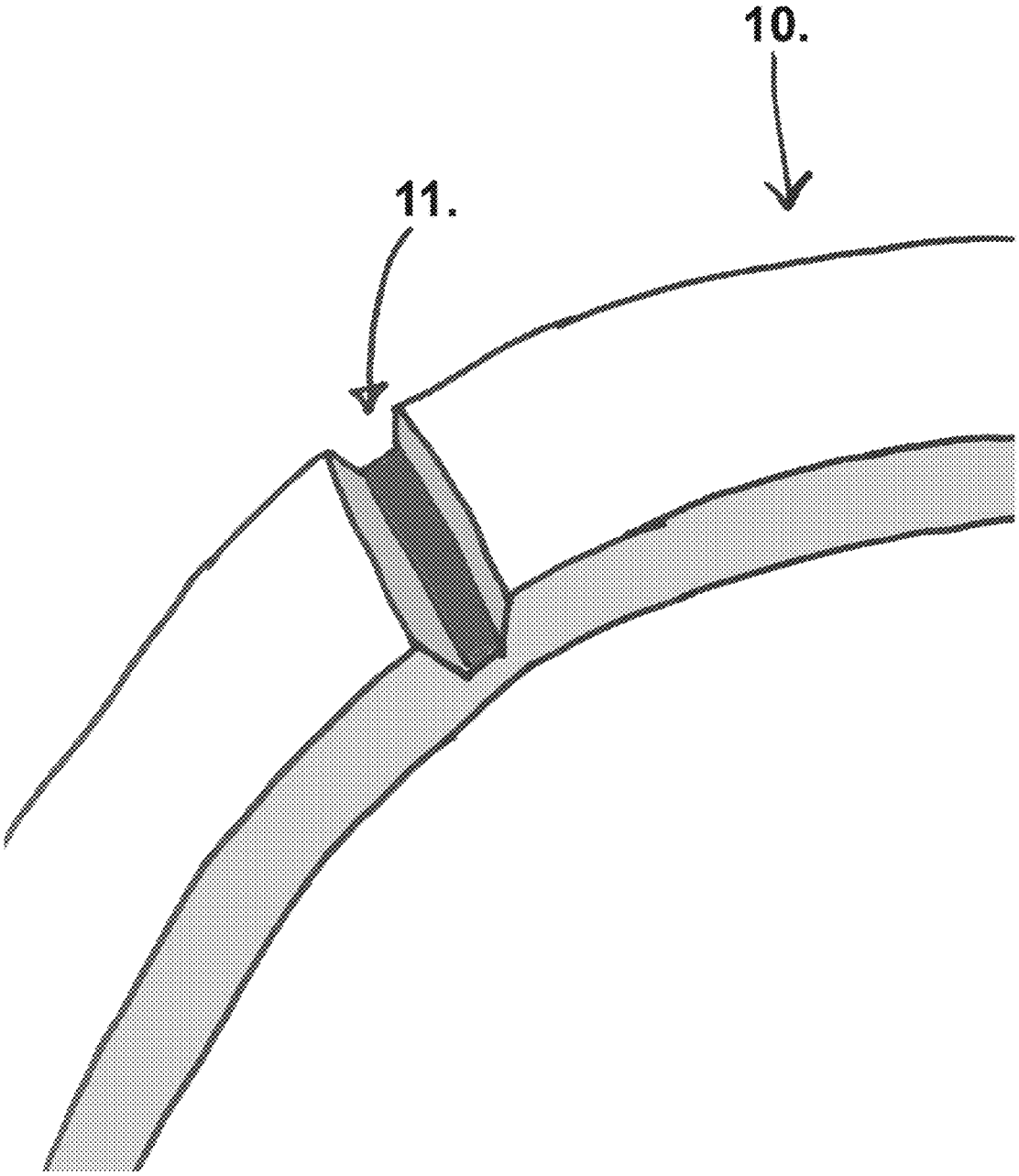
FIG. 6 shows a close-up portion of one layer of the circular casing.
Figure 7:
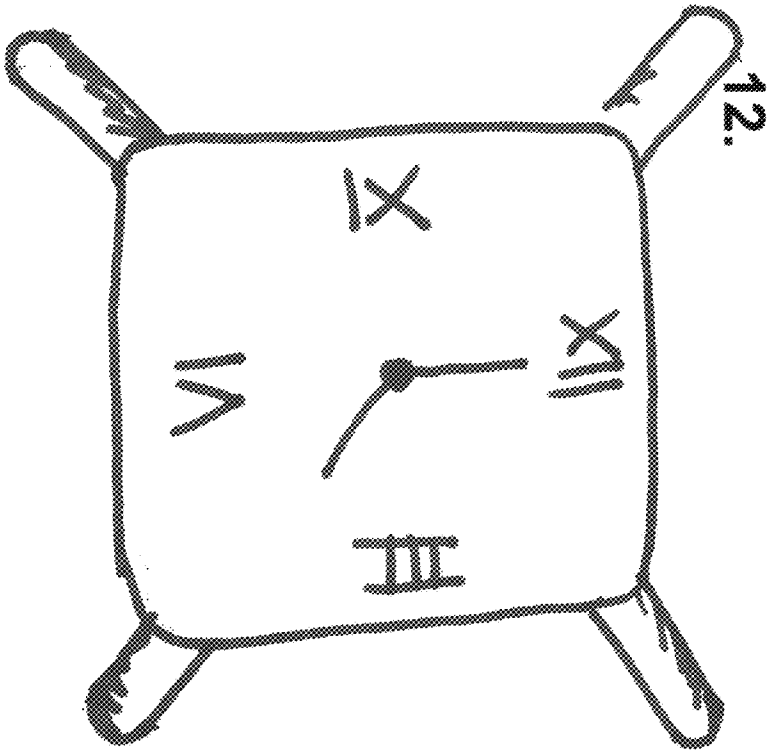
FIG. 7 shows pegs attached to a watch face.
Figure 8:
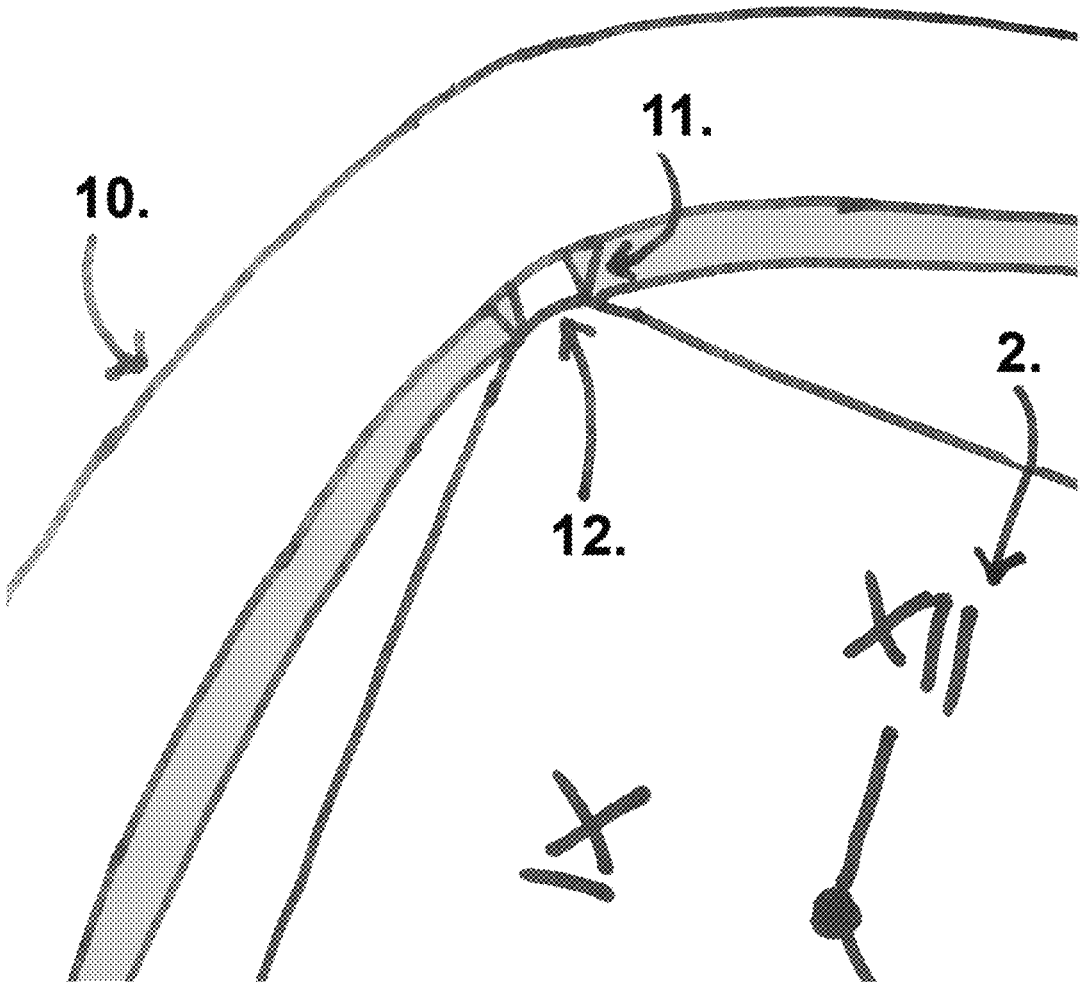
FIG. 8 shows a close-up of a watch face with pegs attached resting in a circular casing.

FIGS. 5-6, 8 depict a donut or torus shaped ring casing around a watch face that may connect either side of a watch band via conventional fastener or may comprise a unitary structure where the donut casing and band are one piece. The donut casing may be configurable to place a watch face on the left or right hand with different sets of peg slots 11 for different arms or different placement on the wrist (traditional or present embodiment).

FIGS. 1-5, 9-10, 12-16 depict wristbands (which may be a unitary construction with the watch face, a single band, or a two-piece band with clasp or other means of joining, composed of leather, rubber, nylon, elastic, chain link or other materials).

FIGS. 1-4, depict embodiments: a wristband allowing a watch face 2 to be positioned on the lateral radial portion of the wrist, over the anatomical snuff-box, with the vertical axis (with respect to a 12:00 position of conventional watch hands and/or with respect to a perpendicular section of a display screen) of the watch face 1*b* parallel to the length of a fully-extended pointer finger 1*a*.

One embodiment features one or two rigid or semi-rigid inserts—either removable or non-removable strips or rods, 3&4—that may be placed in or along the broad anterior surface and/or the broad posterior surface of the wrist to hold the band in position to prevent the band from rotating around the wrist, thereby holding the watch face in position over the anatomical snuff-box.

Figure 1:
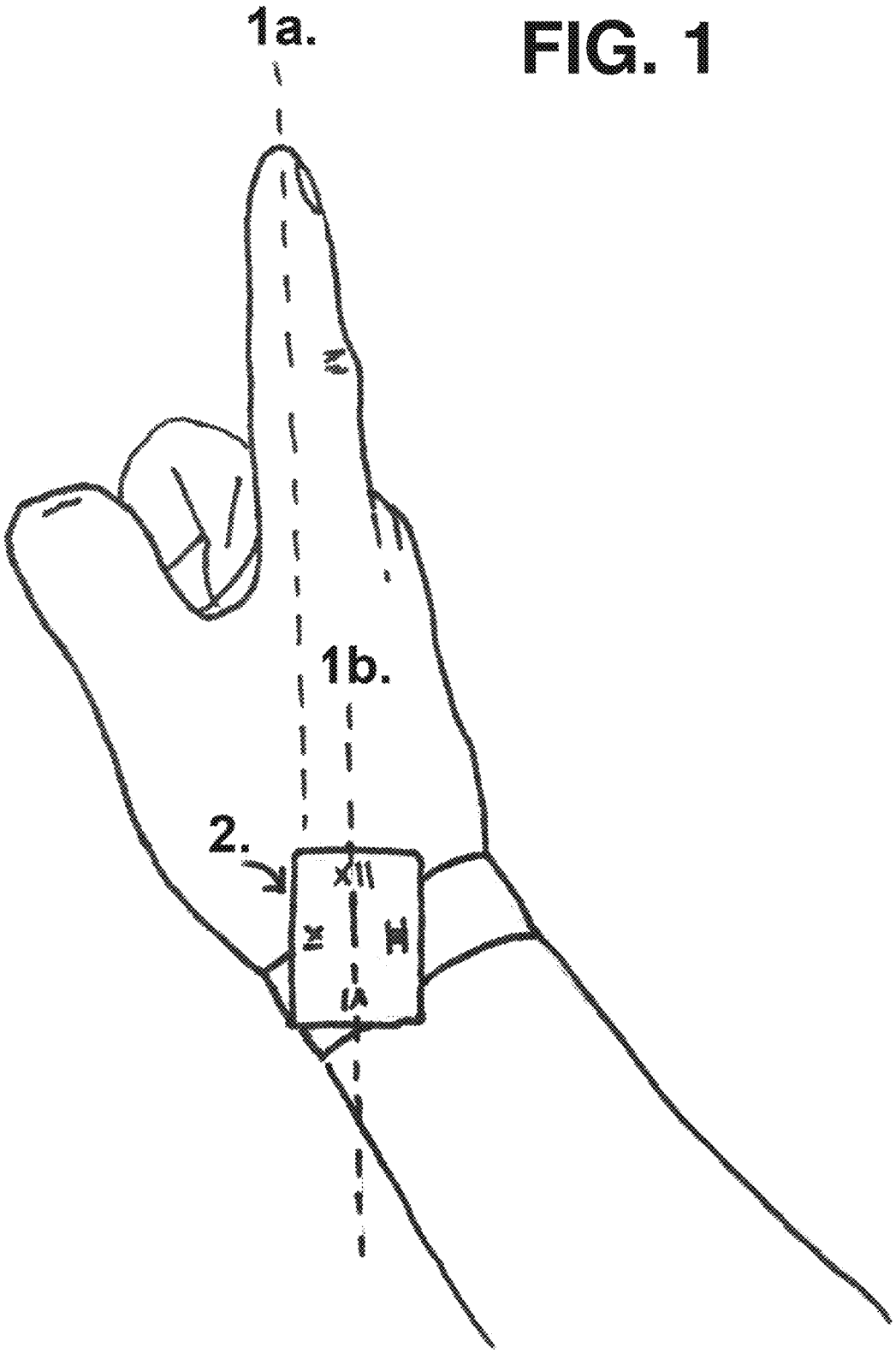
FIG. 1 shows a watchband and watch face in accordance with an embodiment.
Figure 2:
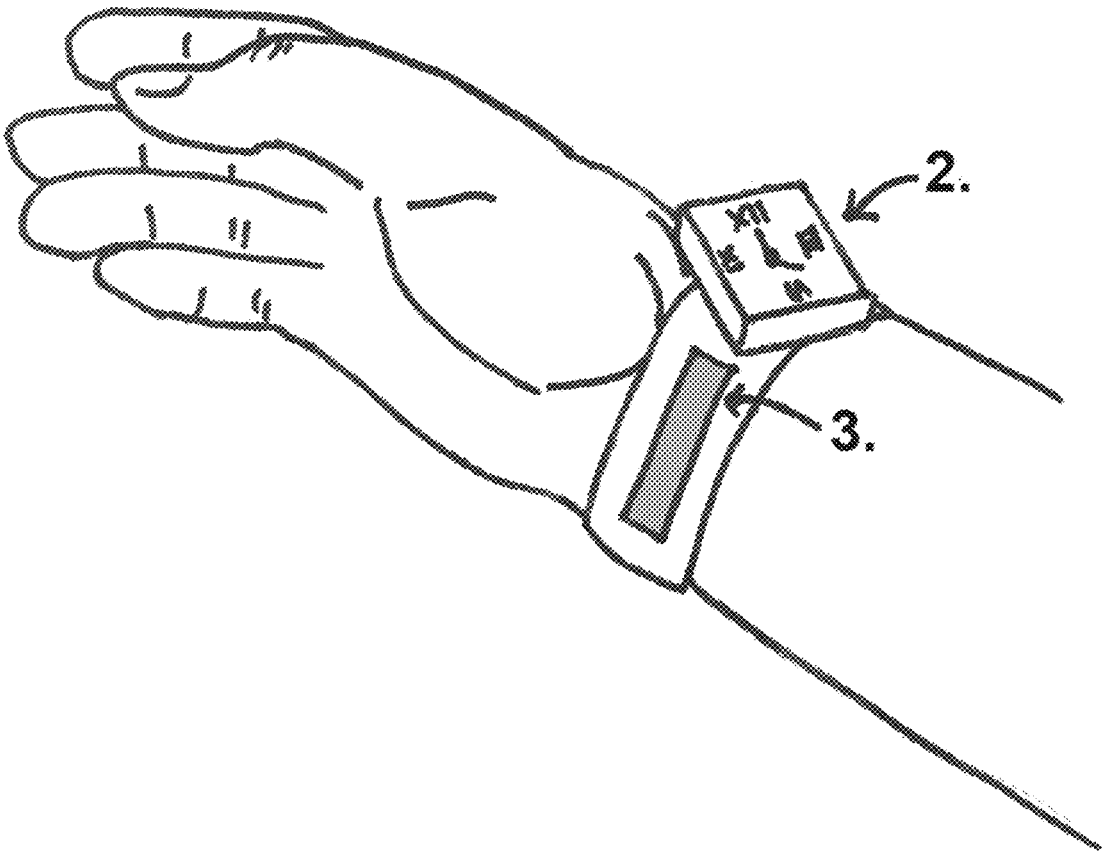
FIG. 2 shows a watchband and watch face in accordance with an embodiment.
Figure 3:
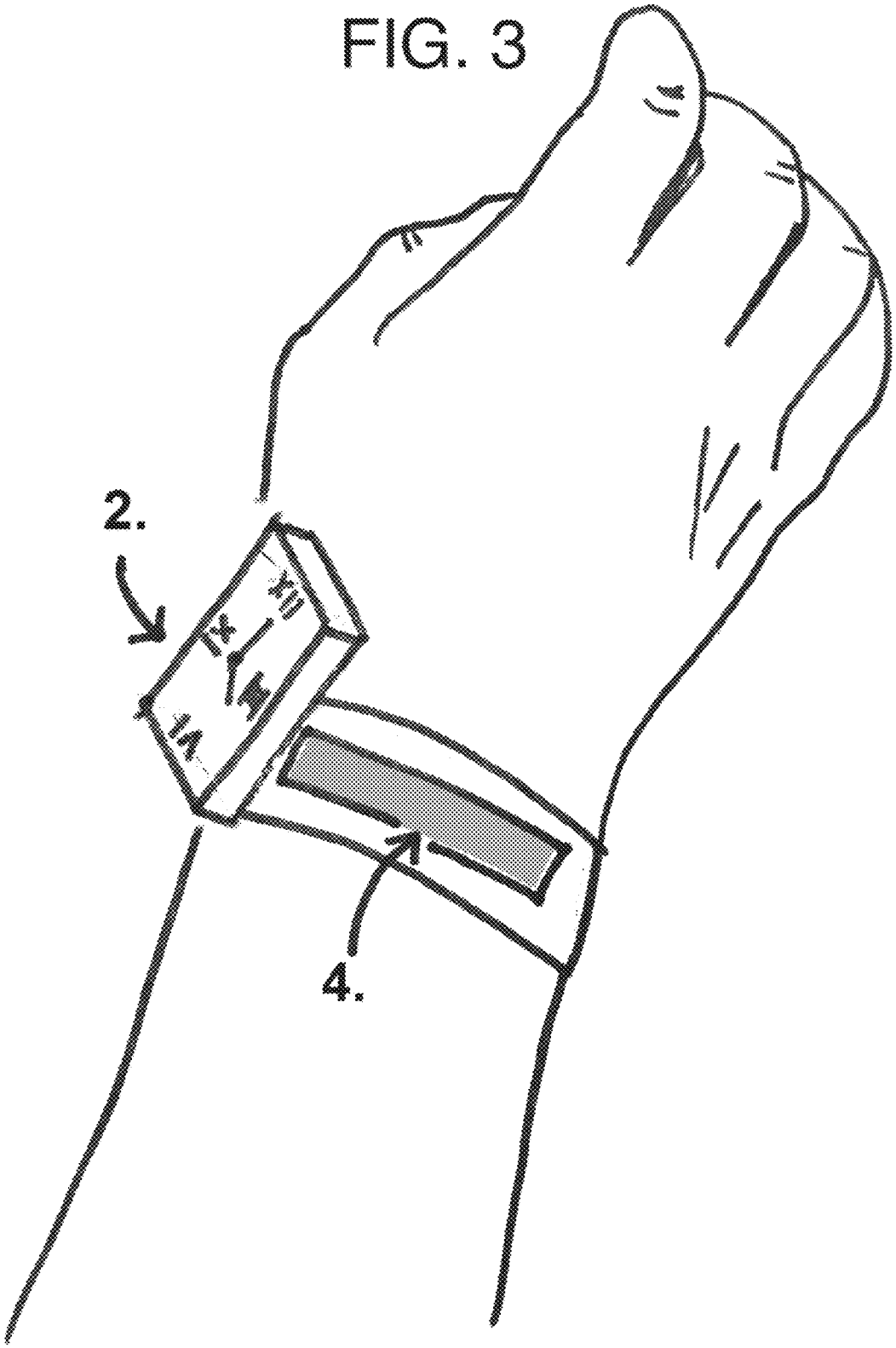
FIG. 3 shows a watchband and watch face in accordance with an embodiment.
Figure 4:
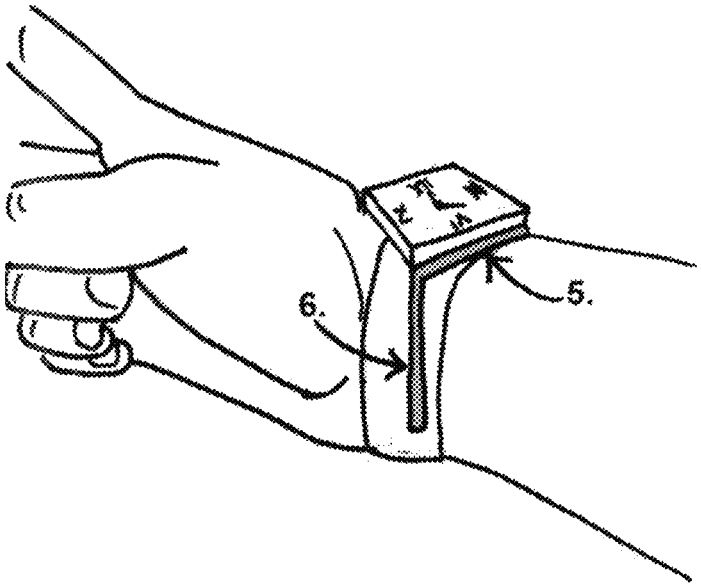
FIG. 4 shows a watch face attached to a rigid angled or curved piece.

FIG. 4 shows another embodiment of the present embodiments, featuring a rigid, curved or angled (hinged or fixed) piece 6 attached along the lower edge of the watch face 5 then bending and following along the broad anterior surface of the wrist either attached to or embedded in the watchband, stabilizing the position of the watch face over the lateral radial portion of the wrist over the anatomical snuff-box.

Figure 9:
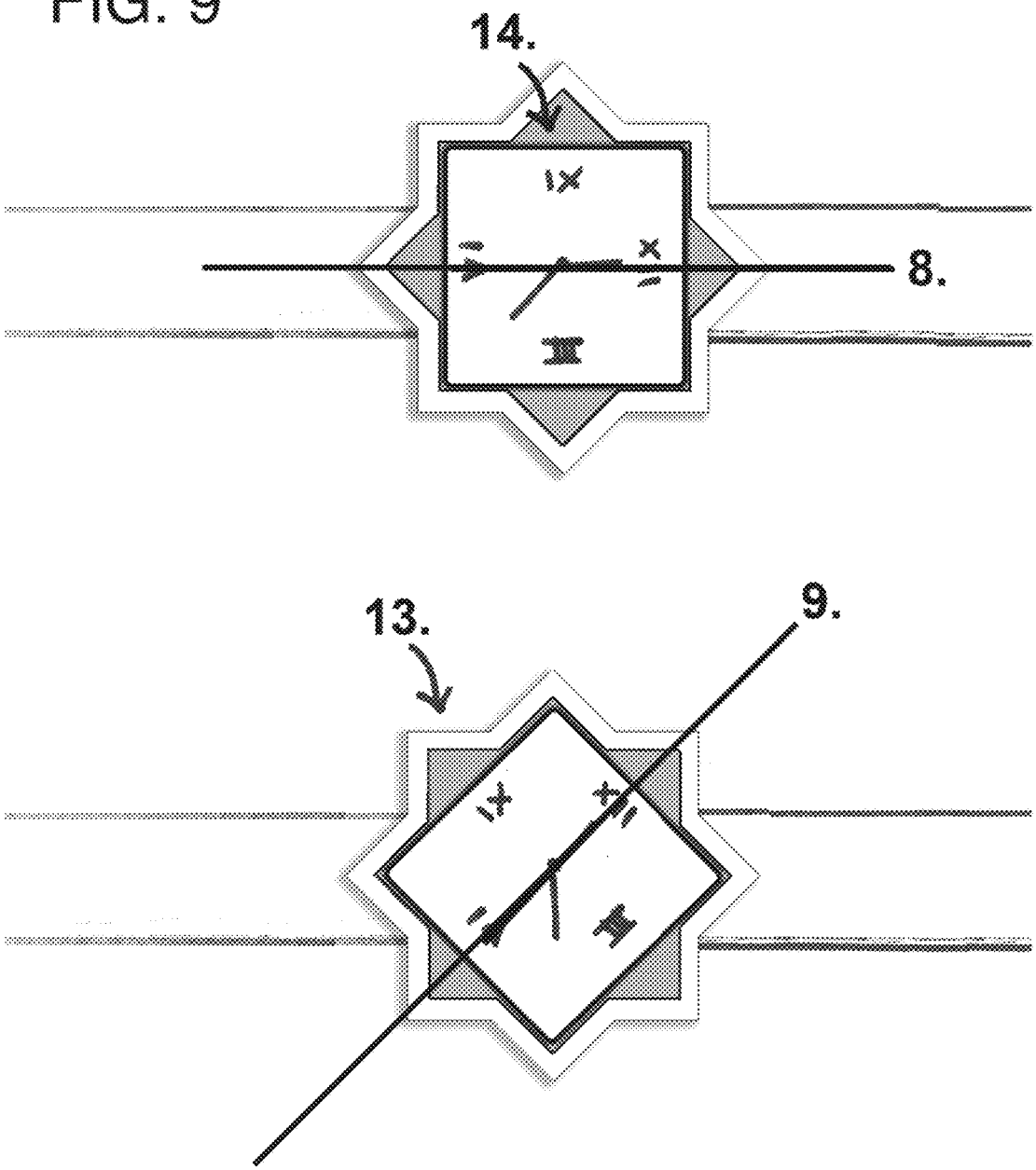
FIG. 9 shows a watch-face casing, watch face, and wristband.

FIGS. 5-9 show another embodiment, featuring either a circular [FIGS. 5-8] casing 7 that circumscribes the watch face or an eight-pointed Armenian star [FIG. 9] shaped casing 13 with a raised border and recessed inner surface 14 on which rests the watch face. Both of these embodiments [FIGS. 5-8 and FIG. 9] allow the watch face to turn radially inside the casing in order to orient it in one of two alternative positions: (1) to be worn in the traditional position 8 on the posterior (or anterior) surface of the wrist, or (2) alternatively to orient it with the vertical axis ~45-60 degrees away from the long axis of the wristband (shown in 9) to be worn on the lateral radial portion of the wrist over the anatomical snuffbox.

The circular casing 7 may be formed of two stacked circular layers 10, with one or both layers having grooves, divots, or recessed portions 11 in which pegs 12 attached to the watch face rest to secure the desired orientation of the watch face.

For FIGS. 5-9, when in position 2, the wristband may have rigid or semi-rigid strip or rod inserts 3&4 present to secure the placement of the watch face over the lateral radial portion of the wrist; whereas in position 1, those inserts would be absent (removed) to let the watch face rest on the posterior (or anterior) surface of the wrist.

Figure 10:
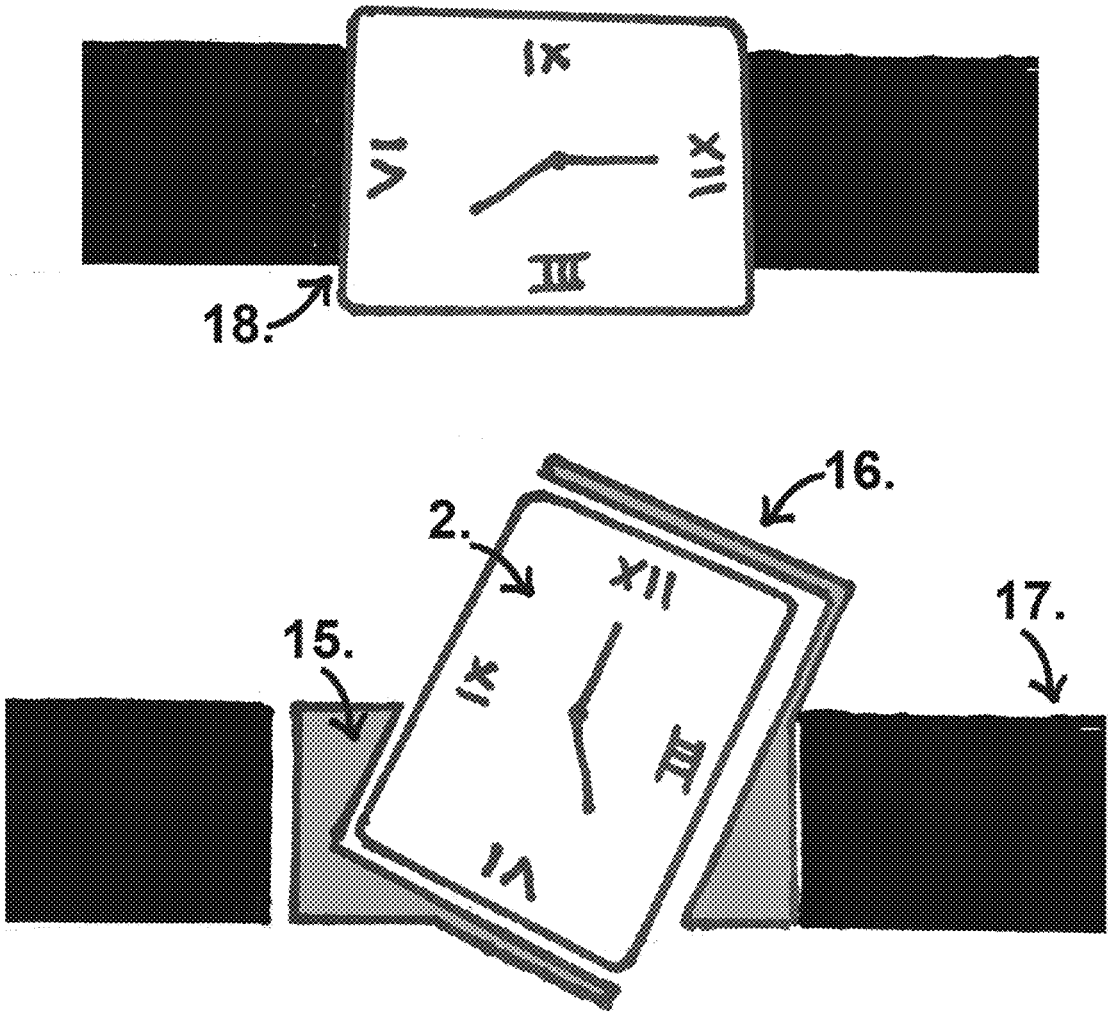
FIG. 10 shows a wristband with attachable adaptations.

FIG. 10 shows two angled adaptor pieces 15&16 that attach to a wristband 17 to modify it so that the watch face is oriented as per the present embodiments to be worn on the lateral radial portion of the wrist over the anatomical snuff-box. Piece 15 is adapted to twice mimic whatever connection mechanism was used to connect the wristband to the watch face in prior art 18: once to connect piece 15 to the wristband, and a second time to connect piece 15 with the bottom edge of the watch face using its existing connectors. Piece 16 is similarly adapted for the top of the watch face. Rigid or semi-rigid inserts or attachments 3&4 may be used in conjunction with 15&16 to convert a traditional wristband for use with the present embodiments.

Figure 11:
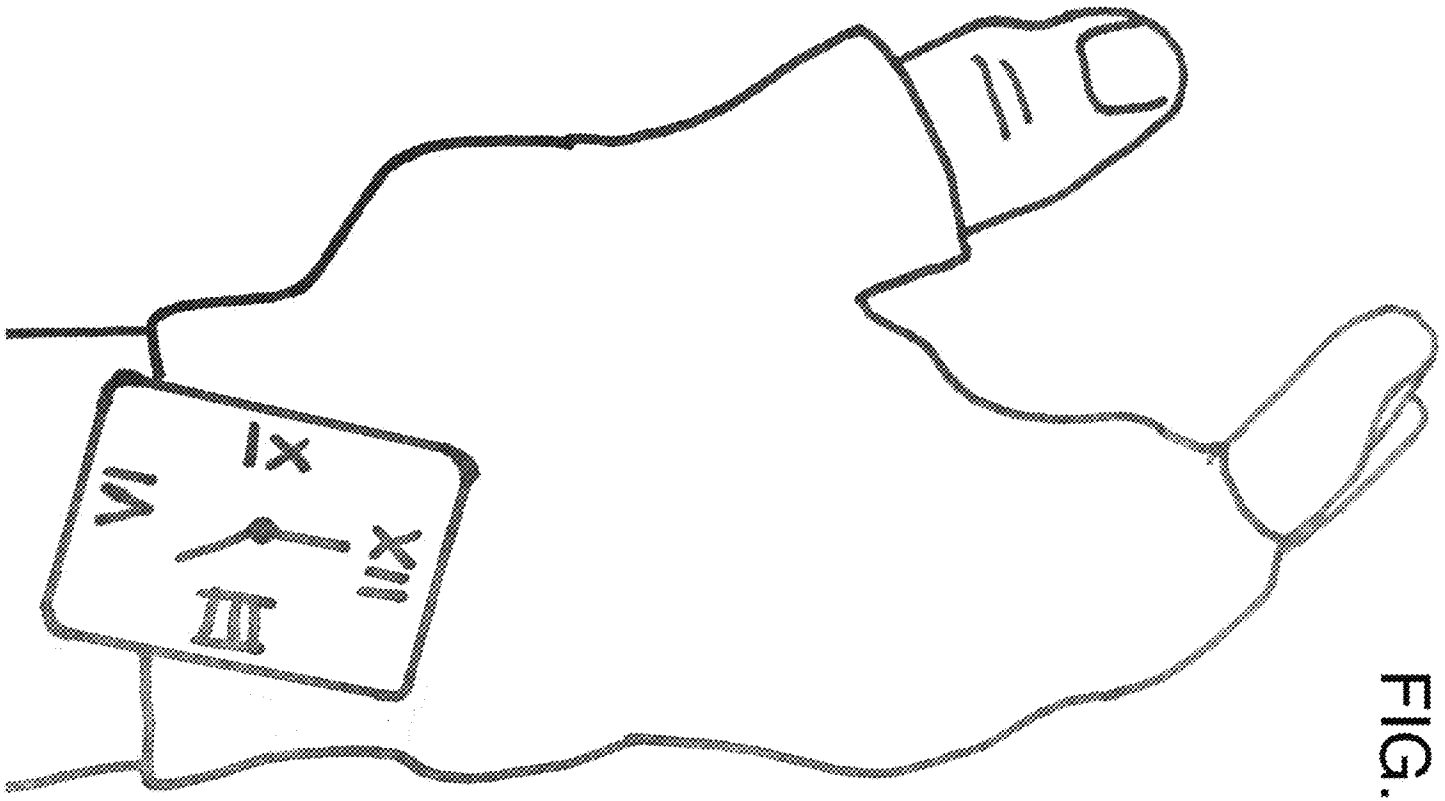
FIG. 11 shows a watch face secured in the cuff of a glove.
Figure 12:
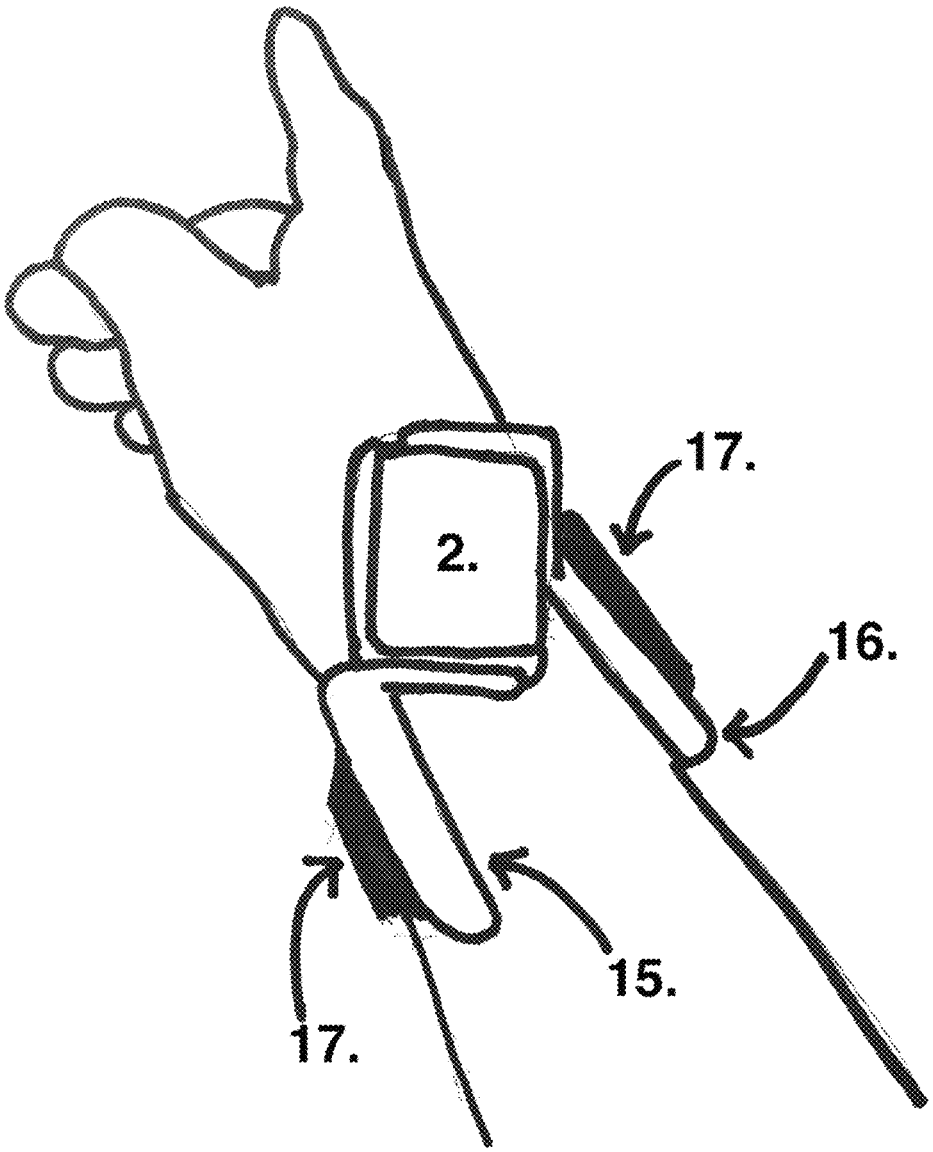
FIG. 12 shows a wristband with attachable adaptations.
Figure 13:
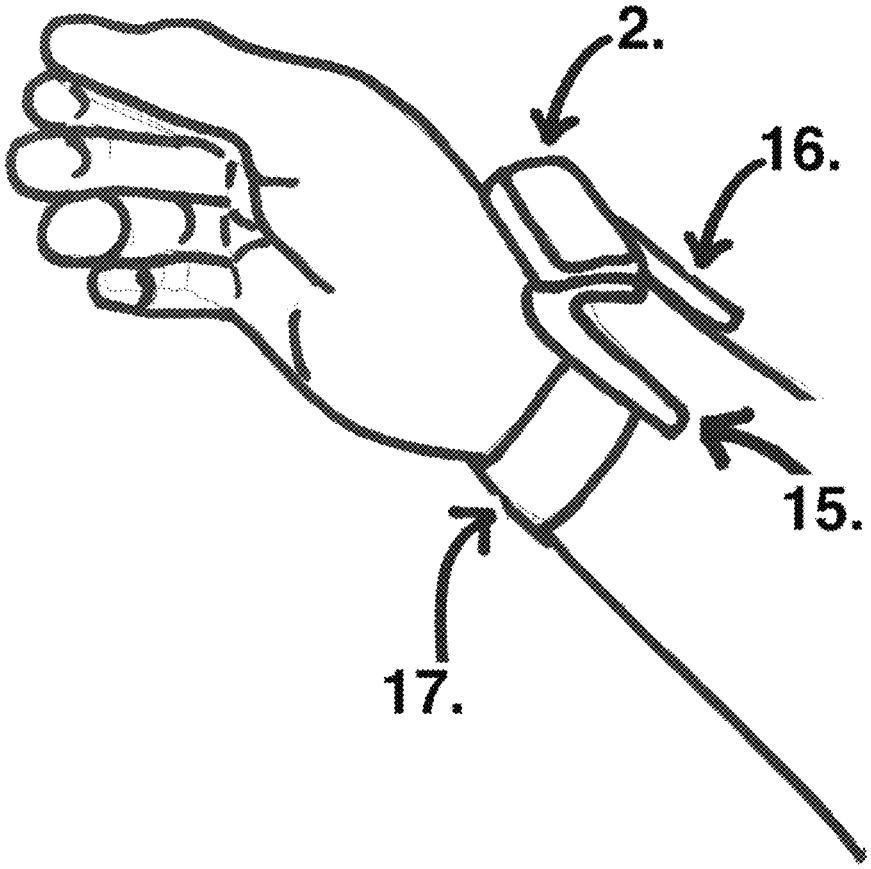
FIG. 13 shows a wristband with attachable adaptations.
Figure 14:
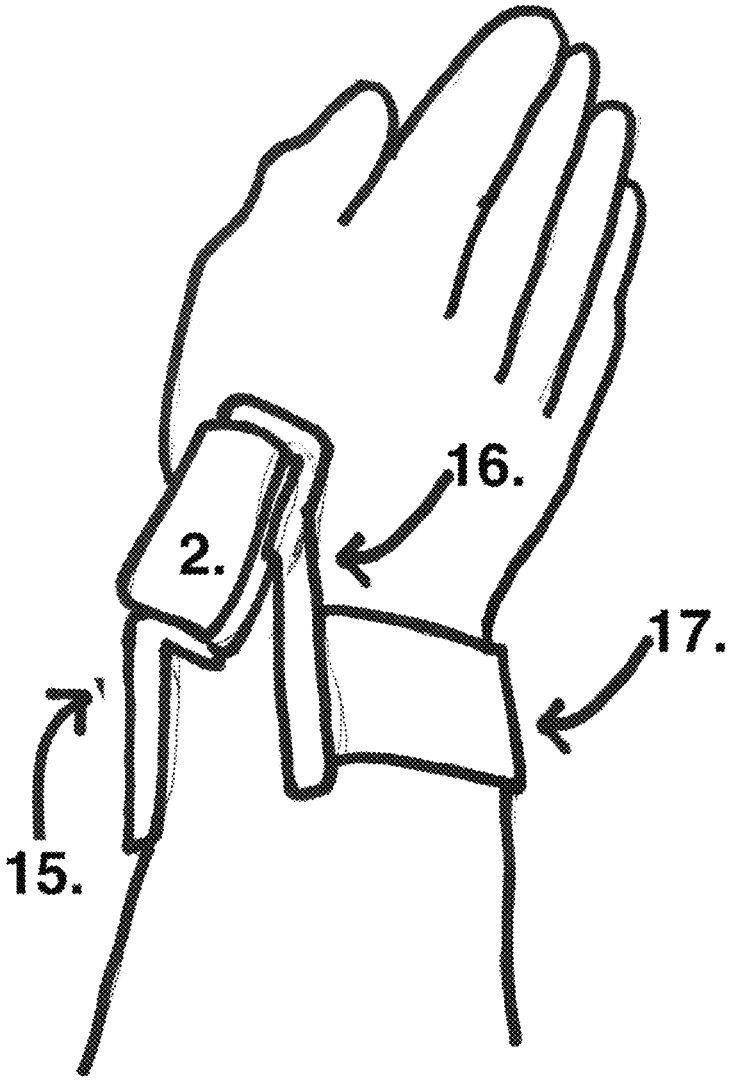
FIG. 14 shows a wristband with attachable adaptations.
Figure 15:
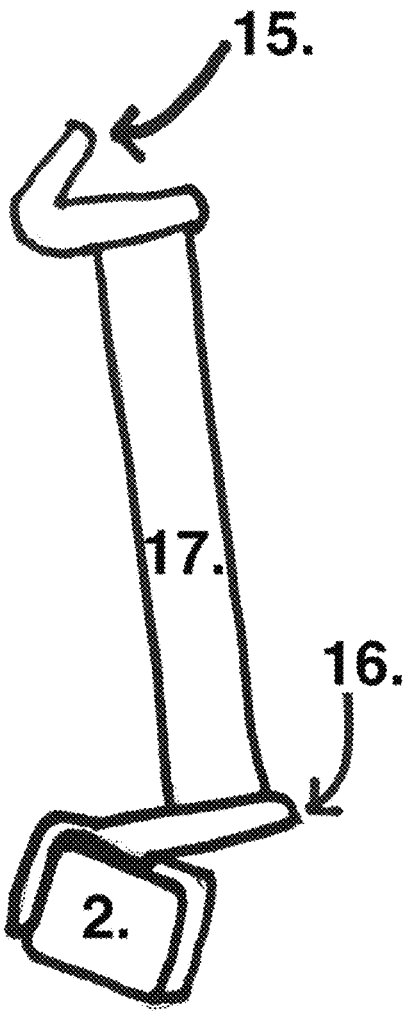
FIG. 15 shows a wristband with attachable adaptations.
Figure 16:
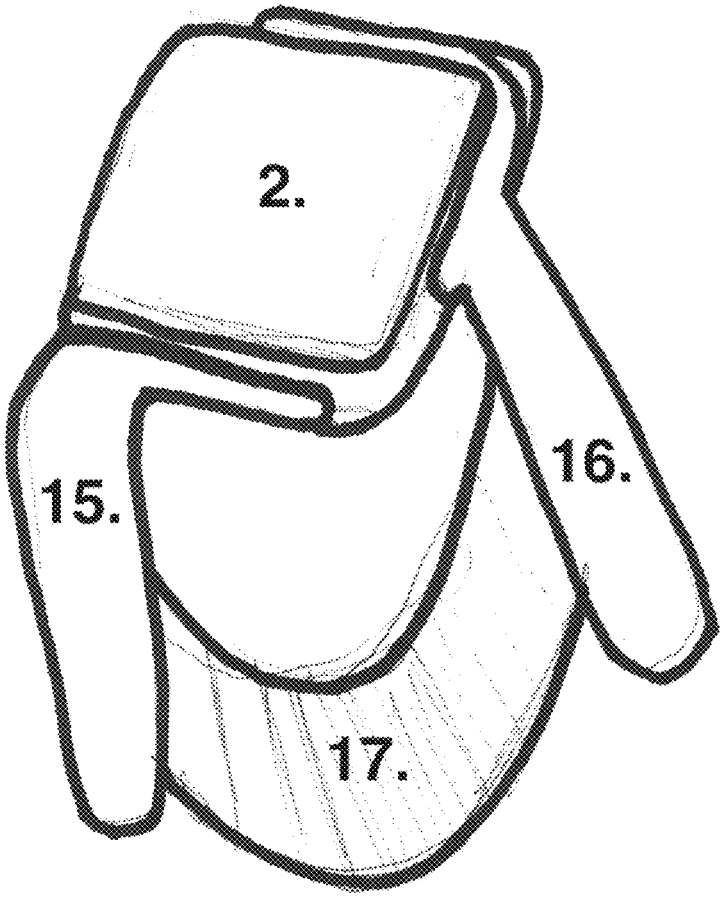
FIG. 16 shows a wristband with attachable adaptations.

FIG. 11 shows another embodiment whereby a watch face is embedded in, sewn into, or otherwise attached to or secured in the cuff of a glove in lieu of or with a built-in wristband to effect the present embodiments, positioning the watch face over on the lateral radial portion of the wrist over the anatomical snuff-box with the vertical axis of the watch face aligned with a natural line of sight in a neutral (or neutral with slight neck flexion) head position.

FIGS. 12-16 show two angled adaptor pieces 15&16 that attach to a wristband 17 to modify it so that the watch face is oriented as per the present embodiments to be worn on the lateral radial portion of the wrist over the anatomical snuff-box. Piece 15 is adapted to twice mimic whatever connection mechanism was used to connect the wristband to the watch face in prior art 18: once to connect piece 15 to the wristband, and a second time to connect piece 15 with the bottom edge of the watch face using its existing connectors. Piece 16 is similarly adapted for the top of the watch face. Rigid or semi-rigid inserts or attachments 3&4 may be used in conjunction with 15&16 to convert a traditional wristband for use with the present embodiments.

Figure 17:
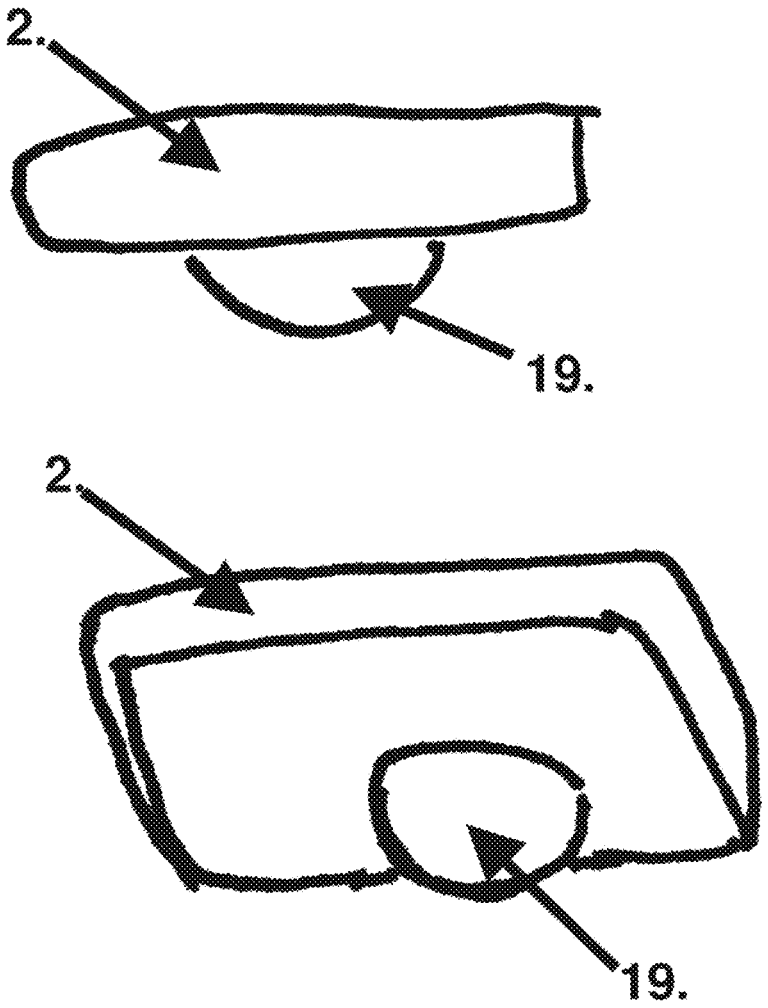
FIG. 17 shows a watch face with a convex buffer member attached to a backside of the watch face

FIG. 17 shows a buffer member that comprises a convex first face 19 to mate with at least a portion of the anatomical snuffbox and a substantially planar second face to adapt to a rear side of the watch face 2.

Figure 18:
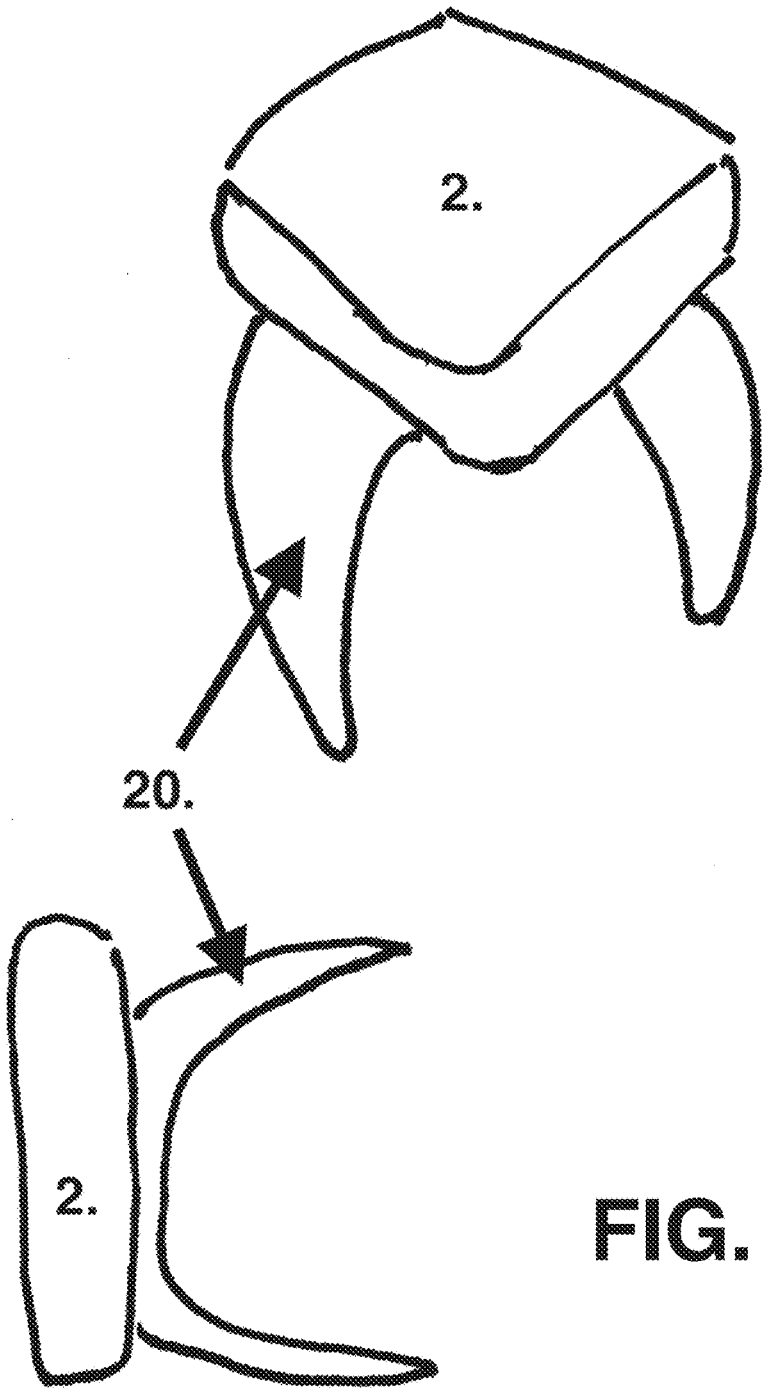
FIG. 18 shows a watch face with a concave buffer member attached to a backside of the watch face

FIG. 18 shows a buffer member that comprises a concave first face 20 to mate with at least a portion of the lateral radial portion of the wrist and a substantially planar second face to adapt to a rear side of the watch face 2.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An apparatus comprising:

a wristband connected, via a first angled adaptor and a second angled adaptor, to a watch face that positions and holds the watch face substantially over at least one of a lateral radial portion of a wrist of a user or an anatomical snuffbox of the user and not over a broad anterior or posterior portion of the wrist and prevents the watch face from rotation to the broad anterior or posterior position;

a first insert on a first external portion of the wristband that is positioned above the broad anterior portion of the wrist that maintains the watch face above the lateral radial portion of the wrist; and a second insert on a second external portion of the wristband that is positioned above the broad posterior portion of the wrist that maintains the watch face above the lateral radial portion of the wrist.

2. The apparatus of claim 1, wherein the watch face comprises at least one of a watch, a smartwatch, a wearable electronic display, a wearable computer display, and a wearable user-input device having a capture device.

3. The apparatus of claim 1, wherein a vertical axis of the watch face is offset from a long axis of the wristband.

4. The apparatus of claim 3, wherein the watch face positioned above the lateral radial portion of the wrist is to substantially reduce wrist pronation, wrist supination, and medial shoulder rotation of the user during prolonged interaction with the watch face, the watch face comprising a smartwatch.

5. The apparatus of claim 3, wherein the watch face is positioned and held by the wristband to enable the vertical axis of the watch face to be parallel to a vertical axis of a user's field of vision from one or more of a neutral head position and a neutral head position with neck flexion, the watch face comprising a smartwatch.

6. The apparatus of claim 1, wherein the first insert comprises a first angled portion that connects with the watch face and a second angled portion that connects with the first external portion of the wristband, the first angled portion angled with respect to the second angled portion.

7. The apparatus of claim 1, wherein the wristband comprises a buffer member on a backside thereof that enables the watch face to be positioned above the lateral radial portion of the wrist.

8. The apparatus of claim 7, wherein the buffer member comprises a concave first face that mates with at least a portion of the anatomical snuffbox and a substantially planar second face that adapts to a rear side of the watch face.

9. The apparatus of claim 7, wherein the buffer member comprises a convex first face that mates with at least a portion of the lateral radial portion of the wrist and a substantially planar second face that adapts to a rear side of the watch face.

10. A smartwatch comprising:

a housing having an electronic display coupled to a power source, a processor and a storage device;

a wristband affixed to the housing, the wristband having a long axis to be circumscribed about a wrist of a user, wherein the wristband maintains a vertical axis of the electronic display offset from the long axis of the wristband and maintains positioning of the electronic display substantially over at least one of a lateral radial portion of the wrist of the user or an anatomical snuffbox of the user; and one or more stabilization members on the wristband that maintain the electronic display positioning substantially over the at least one of the lateral radial portion or the anatomical snuffbox and prevent rotation of the electronic display to an anterior or posterior portion of the wrist, wherein a first stabilization member is positioned above the anterior portion of the wrist.

11. The smartwatch of claim 10, wherein the wristband maintains positioning of the electronic display substantially over the lateral radial portion of the wrist to substantially reduce wrist pronation, wrist supination, and medial shoulder rotation of the user during prolonged interaction with the electronic display.

12. The smartwatch of claim 10, wherein the wristband maintains positioning of the electronic display having the vertical axis of the electronic display to be parallel to a vertical axis of a user's field of vision from one or more of a neutral head position and a neutral head position with neck flexion.

13. The smartwatch of claim 10, wherein a second stabilization member is positioned above the posterior portion of the wrist.

14. The smartwatch of claim 10, wherein the wristband is affixed to the housing via a first angled adaptor and a second angled adaptor.

* * * * *